United States Patent [19]

Rolff et al.

[11] 4,151,391

[45] Apr. 24, 1979

[54] CONTACT ARRANGEMENT FOR A PRESSURIZED GAS CIRCUIT BREAKER

[75] Inventors: Klaus-Peter Rolff; Heinz-Helmut Schramm, both of Berlin, Fed. Rep. of Germany

[73] Assignee: Siemens Aktiengesellschaft, Munich, Fed. Rep. of Germany

[21] Appl. No.: 794,796

[22] Filed: May 9, 1977

[30] Foreign Application Priority Data

May 28, 1976 [DE] Fed. Rep. of Germany ..... 2624595

[51] Int. Cl.[2] ..... H01H 33/18

[52] U.S. Cl. ..... 200/147 R; 200/147 A; 200/148 R

[58] Field of Search ..... 200/147 A, 147 R, 148 R

[56] References Cited

U.S. PATENT DOCUMENTS

| | | | |
|---|---|---|---|
| 2,725,446 | 11/1955 | Scepian | 200/147 A |
| 3,891,814 | 6/1975 | Hertz et al. | 200/147 R |
| 4,032,736 | 6/1977 | Ruffleux et al. | 200/147 R |
| 4,052,577 | 10/1977 | Votta | 200/147 R |

FOREIGN PATENT DOCUMENTS

| | | | |
|---|---|---|---|
| 1207988 | 12/1965 | Fed. Rep. of Germany | 200/147 R |
| 1246084 | 8/1967 | Fed. Rep. of Germany | 200/147 A |
| 189061 | 12/1966 | U.S.S.R. | 200/147 A |

*Primary Examiner*—Robert S. Macon

*Attorney, Agent, or Firm*—Kenyon & Kenyon, Reilly, Carr & Chapin

[57] ABSTRACT

A contact arrangement for a pressurized-gas circuit breaker, wherein the contact arrangement comprises a first tubular contact member and a second tubular contact member axially arranged therewith. The contact arrangement is further provided with a hollow cylinder means of ferromagnetic material which is arranged in the interior of the first tubular member and is formed from a multiplicity of laminated metal washers which are insulated from one another and are arranged axially with respect to the first tubular member.

6 Claims, 4 Drawing Figures

CONTACT ARRANGEMENT FOR A PRESSURIZED GAS CIRCUIT BREAKER

BACKGROUND OF THE INVENTION

1. Field of the Invention

The invention relates to a contact arrangement for a pressurized gas circuit breaker wherein the contact arrangement comprises: a first tubular contact member and a second contact member axially arranged therewith, an arc being drawn between said contact members and blasted by pressurized gas when the breaker is interrupted under load; a nozzle body arranged at the end face of the first contact member; and a hollow cylindrical means of ferromagnetic material arranged within the first contact member.

2. Description of the Prior Art

The interrupting capacity of a high-voltage power circuit breaker under conditions of a terminal short circuit and a remote short circuit can be made larger by increasing the resistance of the arc channel in the immediate time-wise vicinity of the current zero crossing. There are essentially two ways to increase this resistance. The first way is to intensively cool the arc. In air-blast breakers, the arc is cooled by the pressurized gas stream released during the interrupting process. In this process, the conducting cross section of the arc is reduced or the resistance per unit of length of the arc is increased.

The second way to increase the resistance of the arc channel is to lengthen the arc itself. Such a lengthening of the arc depends largely on the contact arrangement. It can be achieved for example, by the use of tubular contacts having hollow nozzle-shaped bodies at their end faces wherein the arc bases (burn spots) are driven into the nozzles under the influence of the gas stream. This effect brought about by the use of tubular contacts and nozzle-shaped bodies can be further enhanced by additionally arranging a hollow cylindrical means of ferromagnetic material within the interior of the tubular members. These cylindrical means can be designed so that an electromagnetic force drives the arc bases further into the nozzles, thereby additionally lengthening the arc.

However, in the latter type arrangement, when an arc is driven into the interior of the hollow nozzles by the electromagnetic force, restriking of the arc can occur. Such restriking can reestablish the arc bases on the rim of the nozzles, thereby adversely affecting the initiated quenching process.

It is an object of the present invention to provide a contact arrangement for a pressurized-gas circuit breaker of the above described type wherein restriking of the arc is prevented and, thereby increasing the interrupting capacity of the breaker.

SUMMARY OF THE INVENTION

In accordance with the principles of the present invention the above and other objectives are realized in a contact arrangement of the above described by forming one of the foresaid hollow cylindrical means of a multiplicity of laminated metal washers which are insulated from one another and which are arranged axially with respect to their respective tubular contact member.

With the contact arrangement of the invention so formed, if restriking of the arc between the arc column and a narrow point of the nozzle or an edge of the nozzle occurs, the current can commutate only gradulaly to the new connecting path. The velocity of the transition from the original longer current path to the new, shortened current paty is determined, according to the law of induction, by the time constant $\delta = L/R$, where L is the inductance between the old and the new current paths and R is the resistance. The larger this inductance, the longer will this commutation be delayed. By use of a cylindrical means comprised of a multiplicity of laminated metal washers each of which may advantageously be formed of electrical sheet material, a comparatively large inductance is obtained. Thereby, a driving voltage, which restores the current flow to the original longer path, is induced in the short-circuited loop. The arc is thereby stabilized in the interior of the nozzle, i.e., along its original longer path.

As can be appreciated, therefore, with present invention the aforesaid inductance between the new and old current paths is increased in a simple manner, especially since it is, in general, not possible to build an inductance in the form of a coil or a winding into the current path of the arc. Also advantageously, the metal washers of the invention can be insulated from each other in a similar menner as that used for stacks of laminated cores of transformers.

In one embodiment of the invention to be disclosed hereinafter, the laminated washers are supported by a common support tube which together with the washers forms a single structural unit. The aforesaid structural unit can be arranged in the interior of the contact member so as to be in spacing relationship to the interior surfaces of the contact. Also the support tube can support the washers by extending through the interiors of the washers. In another embodiment of the invention, the support tube is provided with a projecting flange which is pressed into the contact member together with the nozzle body of the contact. The latter arragnement can further be advantageously modified by employing the nozzle body to support the structural unit.

BRIEF DESCRIPTION OF THE DRAWINGS

The above and other features and aspects of the present invetnion will become more apparent by reading the following detailed description in conjunction with the accompanying drawing, in which.

DETAILED DESCRIPTION

Figure 1:
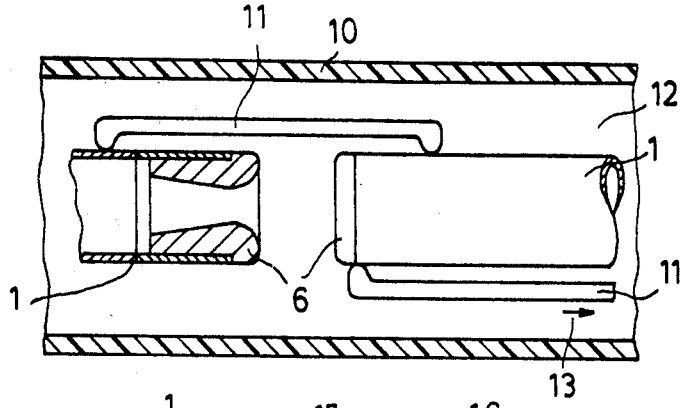
FIG. 1 shows a power circuit breaker in which the contact arrangment of the present invention can be advantageously employed.

FIG. 1 shows a power circuit breaker in the form of a pressurized-gas circuit. As shown, the circuit breaker comprises an arcing chamber 10 formed, for example, of porcelain, which contains a gaseous insulating medium, e.g., sulfur hexafluoride. In the interior 12 of the arcing chamber 10 are arranged two tubular axially arranged contact members 1. At their opposing free end faces, the members 1 carry graphite electrodes 6 which function to carry the conducting arc arising when the circuit breaker opens. Each graphite electrode 6 is ring-shaped, e.g., in the form of a nozzle, whereby the electrode functions to remove the hot gases produced while the aforesaid arc is bruning. In the course of the switching action of the breaker, the arc bases, i.e., the points whereat the arc burns, are condcuted through the interior of the electrodes 6 into the tubular contact members 1.

In the illustrative case shown in FIG. 1, the portion of the drawing above the center line, shows the breaker in the "on" position, while the portion of the drawing below the center line, shows the breaker in the "off" position. In the "on" position, the two contact members 1 are connected to each other in an electrically conducting manner by a bridging contact 11. In the "off" position, the switching gap formed between the two contact members 1 is released by the bridging contact 11, which, having previously been moved in the direction of the arrow 13, no longer connects the members.

Figure 2:
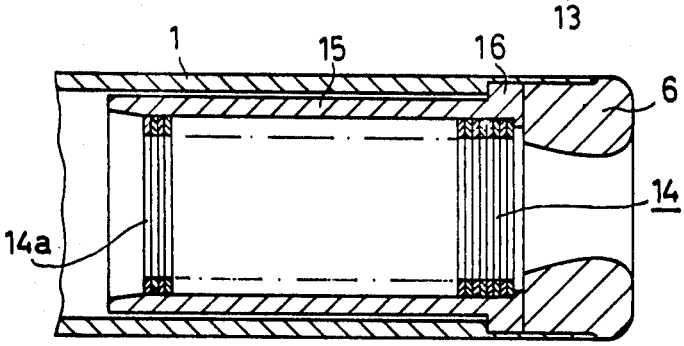
FIG. 2 shows a contact arrangement in accordance with the principles of the present invention.

FIG. 2 shows the contact arrangement of FIG. 1 modified in accordance with the principles of the present invention. As shown, the arrangement is further provided with hollow cylindrical members 14 each of which is arranged in the interior of one of the tubular contact members 1. The cylindrical members 14 are formed of a multiplicity of metal washers **14*a* which are electrically insulated from one another and are arranged or stacked axially with respect to their respective tubular contact member 1. In the illustrative embodiment of FIG. 2, the laminated washers 14*a* of the hollow cylindrical member 14 are connected to each other electrically by means of an outer support tube 15 common to all of them. The tube 15 is spaced from the interior of the member 1 and together with the washers 14*a* forms a single structural unit. The support tube 15 is further provided with a projecting flange 16 which is pressed into the tubular contact member 1 together with the nozzle body 6**.

Figure 3:
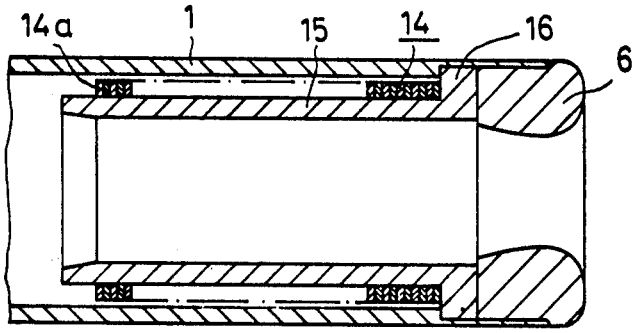
FIG. 3 shows a modified form of the contact arrangement of FIG. 2.

FIG. 3 shows a similar contact arrangement as that shown in FIG. 2, with the exception that in this case the support tube 15 is arranged so as to extend through the interior of the hollow cylindrical member 14 found by the washers **14*a***. This type of arrangement is advantageous for achieving a lasting guidance of the arc.

Figure 4:
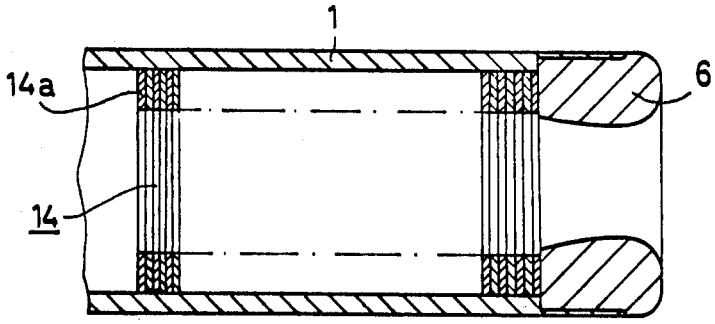
FIG. 4 shows a further contact arrangement in accordance with the principles of the present invention.

FIG. 4 shows a further contact arrangement in accordance with the invention wherein a hollow cylindrical member 14 formed similarly to the member 14 of FIGS. 2 and 3 is directly inserted into the interior of its respective tubular contact member 1, with its outer surfaces against the interior surfaces of the contact.

What is claimed is:

1. In a contact arrangment for use in pressurized-gas circuit breakers, the contact arrangement including: a first tubular contact member; a second contact member axially arranged therewith, an arc being drawn between said contact members and blasted by pressurized gas when the breaker is interrupted under load; a nozzle body arranged at the end face of said tubular contact member; and a hollow cylindrical means formed of ferromagnetic material arranged in the interior of said tubular member; the improvement comprising:

said cylindrical means comprising a multiplicity of laminated metal washers which are electrically insulated from one another and are arranged axially with respect to said tubular member.

2. The improvement of claim 1 further comprising:

a support tube for supporting said metal washers, to thereby form a structural unit.

3. The improvement of claim 1 wherein:

said structural unit is arranged within said tubular member so as to be spaced from the interior surfaces of said tubular member.

4. The improvement of claim 2 wherein:

said support tube passes through the interiors of said washers.

5. The improvement of claim 2 wherein:

said support tube has a projecting flange which is pressed into the tubular member together with said nozzle body.

6. The improvement of claim 5 wherein:

said structural unit is supported by said nozzle body.

* * * * *